US005799631A

United States Patent [19]

Nakamura

[11] Patent Number: 5,799,631

[45] Date of Patent: Sep. 1, 1998

[54] APPARATUS FOR CONTROLLING ENGINE VALVE PERFORMANCE

[75] Inventor: Hideo Nakamura, Toyota, Japan

[73] Assignee: Toyota Jidosha Kabushiki Kaisha, Toyota, Japan

[21] Appl. No.: 948,338

[22] Filed: Oct. 9, 1997

[30] Foreign Application Priority Data

Oct. 15, 1996 [JP] Japan ..... 8-272230

[51] Int. Cl.[6] ..... F02D 13/02; F01L 1/344

[52] U.S. Cl. ..... 123/90.17; 123/90.33; 123/90.34; 123/196 M

[58] Field of Search ..... 123/90.12, 90.15, 123/90.16, 90.17, 90.18, 90.31, 90.33, 90.34, 90.38, 196 M

[56] References Cited

U.S. PATENT DOCUMENTS

| | | | |
|---|---|---|---|
| 4,928,641 | 5/1990 | Niizato et al. | 123/90.33 |
| 5,144,921 | 9/1992 | Clos et al. | 123/90.17 |
| 5,170,756 | 12/1992 | Szodfridt | 123/90.17 |
| 5,271,360 | 12/1993 | Kano et al. | 123/90.33 |
| 5,483,930 | 1/1996 | Moriya et al. | 123/90.17 |
| 5,669,343 | 9/1997 | Adachi | 123/90.17 |

FOREIGN PATENT DOCUMENTS

| | | |
|---|---|---|
| 6-330712 | 11/1994 | Japan . |
| 7-139318 | 5/1995 | Japan . |
| 7-139320 | 5/1995 | Japan . |

*Primary Examiner*—Weilun Lo
*Attorney, Agent, or Firm*—Kenyon & Kenyon

[57] ABSTRACT

A variable valve timing mechanism (VVT) for adjusting the valve timing of an intake valve of an internal combustion engine. The mechanism is hydraulically driven by oil pressure. An oil control valve (OCV) is provided on a cylinder head of the engine for controlling oil flow from a pump. A drainage pan in the cylinder head receives oil drained from various mechanical components of the engine. A drain passage drains oil from the control valve to a drain well. The oil in the drainage pan is also led to the drainage well. A wall, or dam, is formed between the drainage pan and the drainage well for restricting the oil flow from the drainage pan to the drainage well. This prevents the drainage well from being flooded when the flow rate of oil into the drainage pan increases dramatically, which improves the performance of the VVT mechanism.

15 Claims, 3 Drawing Sheets

APPARATUS FOR CONTROLLING ENGINE VALVE PERFORMANCE

BACKGROUND OF THE INVENTION

The present invention relates to an apparatus for controlling the performance of engine valves, and more particularly, to a hydraulic pressure controller used to adjust the performance of intake valves and exhaust valves of an engine.

In the prior art, there are various apparatuses that vary the performance of intake valves and exhaust valves in an engine. For example, Japanese Unexamined Patent Publication No. 8-28219 describes a variable valve timing (VVT) mechanism.

FIG. 3 shows the structure of a typical VVT mechanism, such as that described in the above publication, and its hydraulic pressure control apparatus. As shown in the drawing, a VVT mechanism 81 includes a ring gear 84 arranged on a camshaft 82. Helical splines 83 extend along the outer surface of the ring gear 84. A spring 85 urges the ring gear 84 toward the left, as viewed in the drawing.

An oil pump 86 is provided to supply a linear solenoid type oil control valve (OCV) 87 with oil by way of an oil filter 94 and a supply passage 96. The OCV 87 controls the flow of oil to selectively supply hydraulic pressure chambers 88, 89 with oil by way of first and second passages 97*a*, 97*b*.

The OCV 87 includes a sleeve 90, a spool 91, and a linear solenoid 95. The spool 91 is accommodated in the sleeve 90 and movable axially. The linear solenoid 95 adjusts the moving distance of the spool 91. When the engine is running, the energizing of the linear solenoid 95 is controlled to adjust the moving distance of the spool 91. After adjusting the pressure of the oil, the spool 91 is moved to send the oil selectively to the hydraulic pressure chambers 88, 89.

When the oil is selectively sent to the pressure chambers 88, 89, hydraulic pressure is applied to the ring gear 84 in the axial directions of the camshaft 82. That is, the ring gear 84 is moved to the left or to the right (as viewed in the drawing) in accordance with the hydraulic pressure. The movement of the ring gear 84 changes (advances or retards) the rotational phase of the camshaft 82 with respect to a pulley 92, which is connected to a crankshaft (not shown). This adjusts the valve timing of valves (not shown), which are opened and closed by the rotation of the camshaft 82.

The hydraulic chamber 88, 89 that is not being supplied with oil from the OCV 87 includes residual oil. The residual oil is drained through the associated passage 97*a*, 97*b* and returned to an oil pan 93 by way of the OCV 87 and a drain passage 98.

Generally, the drain passage 98 leads to a cylinder head of the engine. Thus, the drained oil passes through the cylinder head before returning to the oil pan 93. When the engine is running, lubricating oil also flows through the cylinder head to lubricate cams and other components. Therefore, a relatively large amount of oil is constantly collected in a drain hole of the cylinder head to which the drain passage 98 leads.

A large amount of oil may be supplied to the VVT mechanism 81, cams, and cam gears during rotation. This may suddenly increase the amount of oil that flows into the drain hole and increase the oil pressure at the hole. When the pressure in the drain hole approaches the pressure of the drain port of the OCV 87, the draining rate of the oil from the drain passage 98 decreases. This decreases the operating speed of the VVT mechanism 81 and slows the response of the VVT mechanism 81. Thus, when immediate response by the VVT mechanism 81 is required during such state, the desired valve performance may not be achieved. Furthermore, if the pressure in the drain hole becomes higher than the pressure of the drain port of the OCV 87, the pressure may move the spool 91 in the OCV 87. This may displace the spool 91 from the desired position and may lower the controlling capability of the VVT mechanism 81.

SUMMARY OF THE INVENTION

Accordingly, it is an objective of the present invention to provide a valve performance varying mechanism having improved responsiveness.

To achieve the above objective, the present invention provides an apparatus for adjusting the valve performance of an internal combustion engine. The apparatus includes a reservoir for reserving oil, a cylinder head having a drainage pan, wherein the drainage pan receives the oil drained from operating components of the engine, a mechanism for changing the valve performance. The mechanism is hydraulically driven by oil pressure. A control valve is provided for controlling the oil flow to and from the mechanism. A control valve drain passage is provided for draining the oil from the control valve. A drain well is located between the control valve drain passage and the reservoir, and the drain well has an upper opening in the cylinder head. The control valve drain passage has an outlet connected to the drain well, and oil in the control valve drain passage and in the drainage pan is led to the reservoir through the drain well. A barrier positioned between the opening of the drain well and the draining pan for restricting the oil flow from the drainage pan to the drain well.

Other aspects and advantages will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 3:
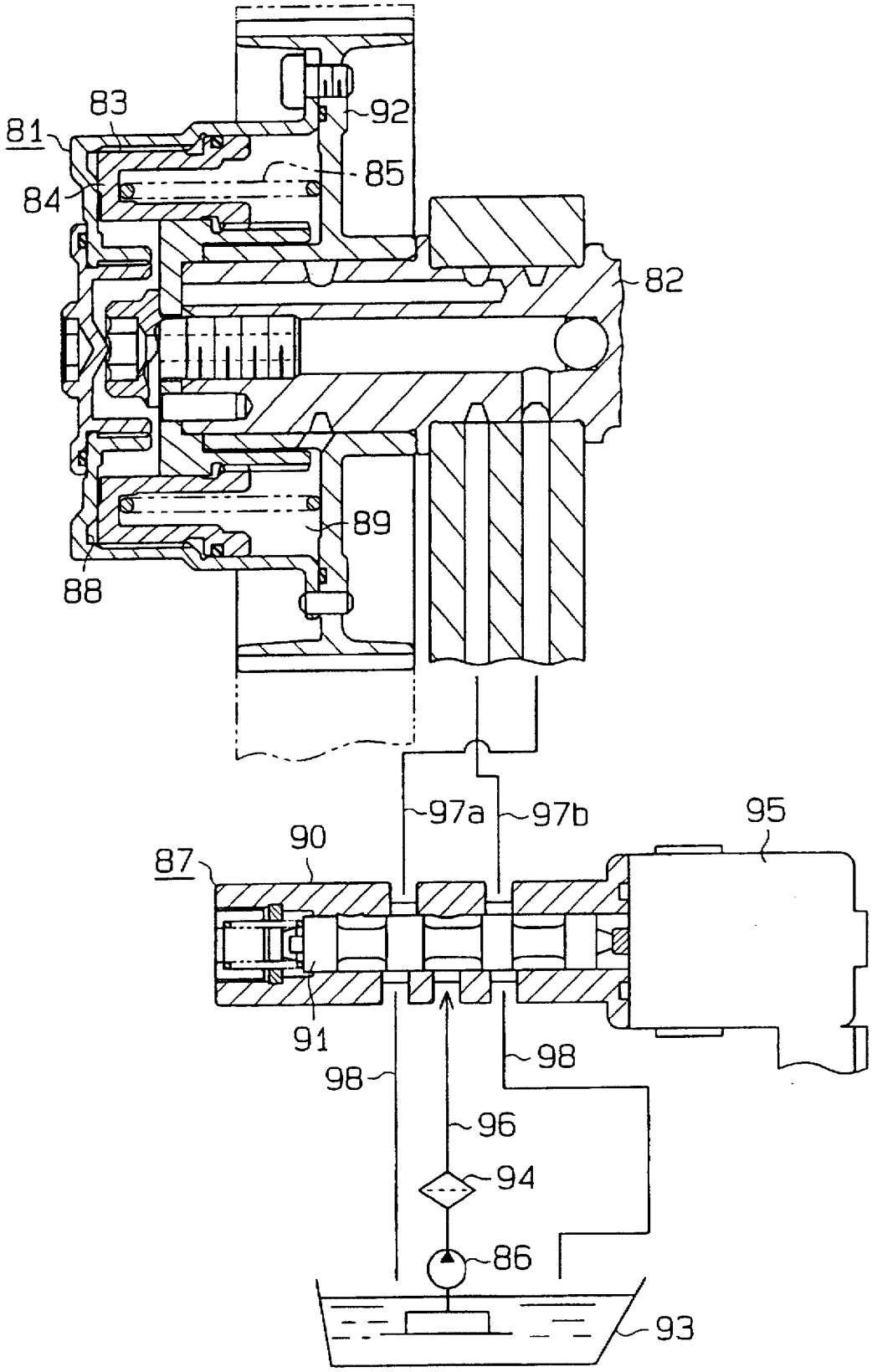
Fig.3 (PRIOR ART)
FIG. 3 is a cross-sectional view showing the structure of a typical variable valve timing mechanism.

A preferred embodiment of a valve performance controlling apparatus according to the present invention will now be described with reference to the drawings. The apparatus is applied to the above ring type variable valve timing (VVT) mechanism and its hydraulic pressure control apparatus. The structure and function of the variable valve timing mechanism is as described above with reference to FIG. 3. Thus, the cylinder head of the engine and the hydraulic pressure control apparatus installed in the cylinder head will be described in detail here.

Figure 1:
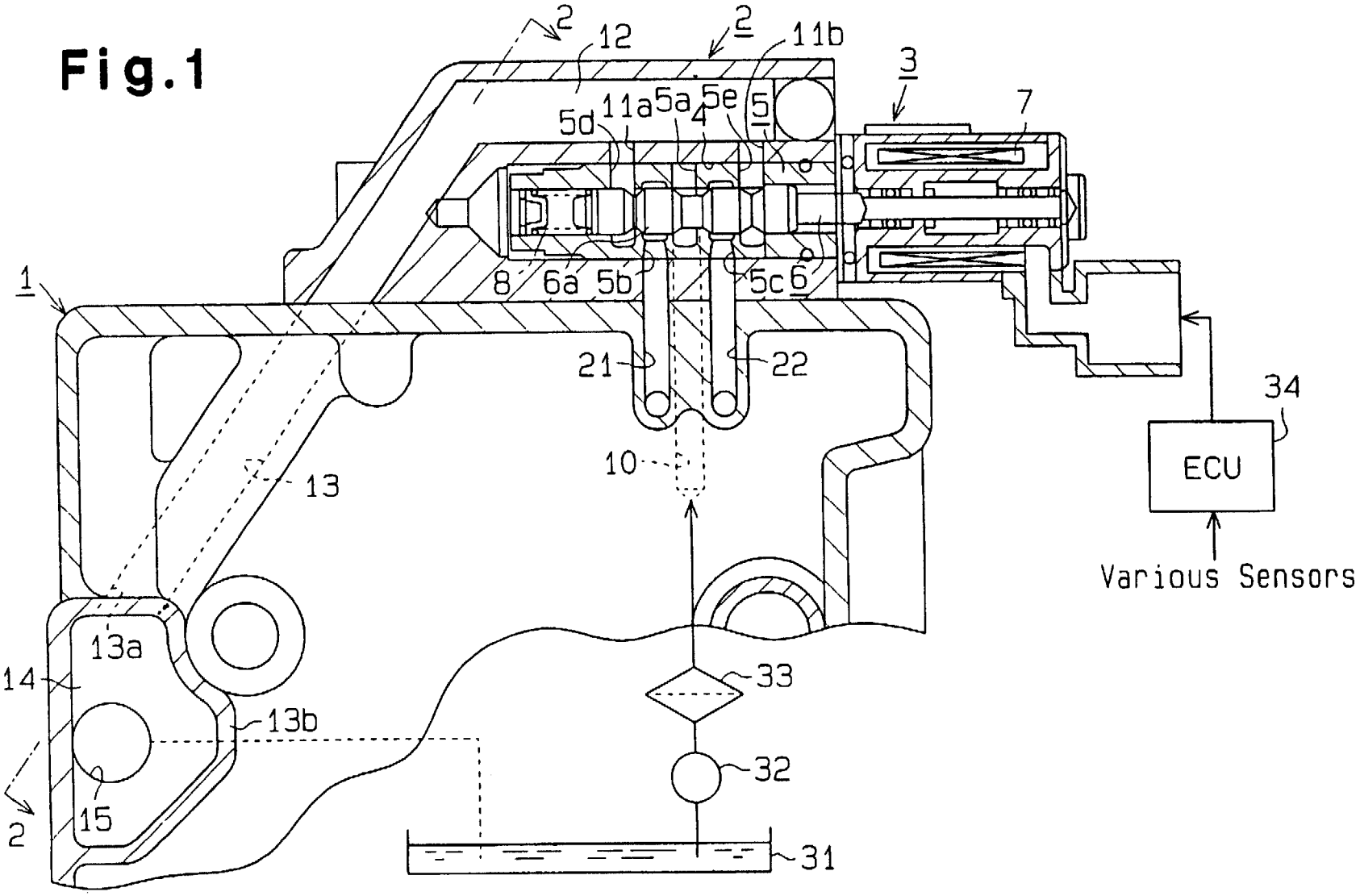
FIG. 1 is a cross-sectional view showing the structure of a cylinder head and an oil control valve from above.
Figure 2:
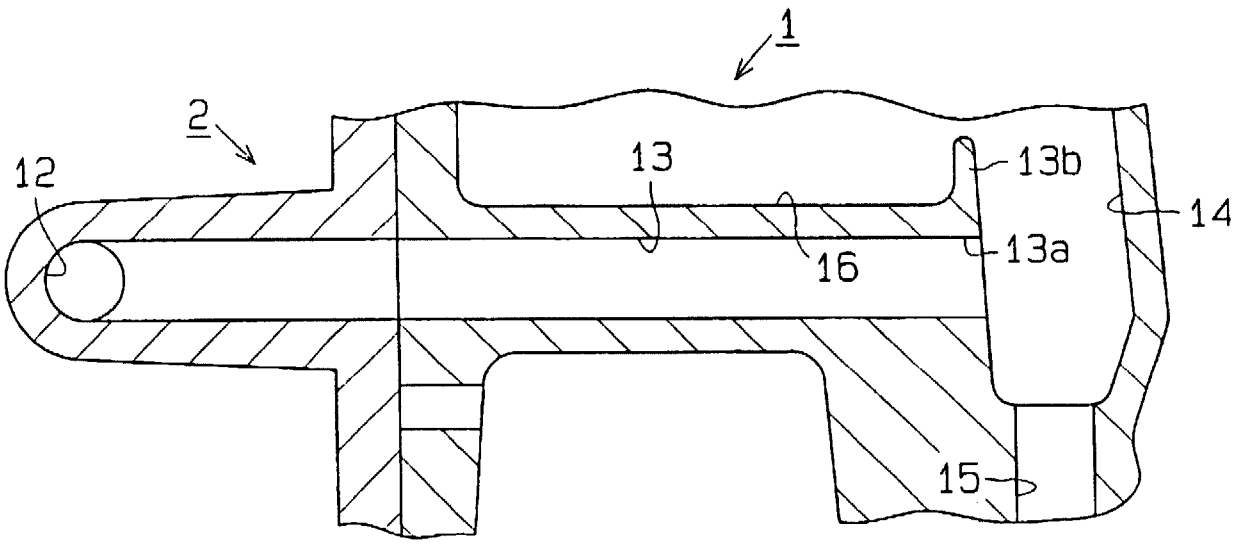
FIG. 2 is a cross-sectional view taken along the plane of line 2—2 in FIG. 1.

As shown in FIGS. 1 and 2, a cylinder head 1 is provided with an attachment 2. The attachment 2 includes an accommodating bore 4 that receives an OCV 3.

The OCV 3 includes a casing 5, a spool 6, an electromagnetic solenoid 7, and a spring 8. The casing 5 is provided with first, second, third, fourth, and fifth ports 5*a*, 5*b*, 5*c*, 5*d*, 5*e* and fitted into the accommodating bore 4. The first port 5*a* is connected to a supply passage 10. Oil is discharged from an oil pump 32 and sent to the supply passage 10 by way of an oil filter 33. The second port 5*b* is connected to a first oil passage 21, while the third port 5*c* is connected to a second oil passage 22. Oil is sent to the VVT mechanism (not shown) from the OCV 3 through the first and second oil passages 21, 22. If the OCV 3 is used to control the hydraulic pressure applied to the VVT mechanism 81 shown in FIG. 3, the first and second oil passages 21, 22 are further connected to the first and second passages 97*a*, 97*b* of the VVT mechanism 81. The fourth port 5*d* is connected to a first drain passage 11*a* while the fifth port 5*e* is connected to a second drain passage 11*b*.

The spool 6 is provided with a plurality of valve portions 6*a*. A spring 8 is arranged at the distal end (the left end as viewed in the drawing) of the spool 6 to constantly urge the spool 6 toward the right. An electromagnetic solenoid 7 is arranged at the proximal end (the right end as viewed in the drawing) of the spool 6. The solenoid 7 is connected to an electronic control unit (ECU) 34, which controls the OCV 3. Energizing of the solenoid 7 causes the spool 6 to move axially in the casing 5. That is, the spool 6 moves axially toward the left or toward the right as viewed in the drawing. The movement of the spool 6 causes the valve portions 6*a* to close and open the first to fifth ports 5*a*–5*e* and adjusts the flow of oil.

The first and second drain passages 11*a*, 11*b* are connected to a drain passage 12. The drain passage 12 is connected with a drain conduit 13 provided in the side of the cylinder head 1. The drain conduit 13 leads to a drainage well 14 defined in a space at an upper portion of the cylinder head.

The drain conduit 13 has an outlet 13*a*, which is located below a wall 13*b*. A drain hole 15 is provided at the lower middle section of the drainage well 14. As seen in FIG. 2, the drainage well 14 is tapered to be smaller in cross-sectional area near its bottom. The drain passage 12, the drain conduit 13, the drainage well 14, and the drain hole 15 are arranged as shown in FIG. 2. The wall 13*b* projects upward from an upper drainage pan 16. The wall 13*b* is a barrier between the oil in the upper drainage pan 16 and the drainage well 14. An oil pan 31 is arranged below the engine block to receive oil from the drain hole 15.

With reference to FIG. 1, the oil collected in the oil pan 31 is discharged from the oil pump 32 and sent to the OCV 3 by way of the oil filter 33, the supply passage 10, and the first port 5*a*. Particulate matter is sieved out of the oil when passing through the oil filter 33.

The ECU 34 is connected to various types of sensors that detect the operating state of the engine (e.g., an engine speed sensor). Based on the detection signals from the sensors, the ECU 34 controls the energizing of the solenoid 7 to adjust the flow of oil in the first to fifth ports 5*a*–5*e*.

The oil controlled by the OCV 3 is sent to the VVT mechanism (not shown in FIG. 1) by way of the second port 5*b* and the first oil passage 21 (when advancing the valve timing) or by way of the third port 5*c* and the second oil passage 22 (when retarding the valve timing). The oil drawn into the VVT mechanism alters the hydraulic pressure in the corresponding hydraulic pressure chamber and varies the valve timing of intake or exhaust valves. The residual oil in the hydraulic chamber that was not pressurized is drained out of the VVT mechanism through the first oil passage 21 (when retarding the valve timing) and the second oil passage 22 (when advancing the valve timing).

The oil drained out of the VVT mechanism returns to the OCV 3. The oil is then drawn into the first drain passage 11*a* from the passage 21 via the fourth port 5*d* or into the second drain passage 11*b* from the passage 22 via the fifth port 5*e*, depending on whether the VVT mechanism is advancing or retarding the valve timing. The oil enters the passage 12 via the drain passages 11*a* or 11*b*. The oil is then sent to the drainage well 14 by way of the drain passage 12 and the drain conduit 13. After reaching the drainage well 14, the oil is returned to the oil pan 31 through the drain hole 15.

As described above, when the engine is running, the lubricating oil used to lubricate cams and other components also flows to the upper drainage pan 16 of the cylinder head 1. This lubricating oil is then sent into the drainage well 14 and toward the drain hole 15. When the amount of the lubricating oil increases significantly due to the operation of components such as the VVT mechanism, the cams, and the cam gears, the amount of lubricating oil sent towards the drain hole 15 may suddenly increase. In the prior art, this may increase the pressure at the drainage area and decrease the draining rate of the oil drained from VVT mechanism.

However, the apparatus according to the present invention is provided with the wall 13*b* that provides a barrier between the oil in the upper drainage pan 16 and the drainage well 14. The wall 13*b* restricts the lubricating oil sent to the upper drainage pan 16 from flowing directly into the drainage well 14 and thus the drain hole 15. That is, the height of the wall 13*b* causes the lubricating oil to collect until its surface rises above the wall 13*b*. This decreases the amount of lubricating oil that flows directly into the drain hole 15. Since there is at least one other drain for the upper drainage pan 16 (not shown), the upper drainage pan 16 does not always stay full to the level of the top of the wall 13*b*.

As a result, the pressure in the drain hole 15 remains low. This allows the oil sent into the drainage well 14 through the drain passage 12 and the drain conduit 13 to return smoothly to the oil pan 31 through the drain hole 15. The smooth flow of the oil guarantees a rapid response by the VVT mechanism.

Accordingly, the structure of the present invention prevents the pressure of the drainage well 14 from affecting the OCV 3 in an undesirable manner. As a result, oil including sludge and other undesirable matter is prevented from flowing back to the OCV 3 through the cylinder head. Thus, the structure of the present invention prevents erroneous operation of the OCV 3 and malfunctions of the OCV 3 caused by sludge or other foreign matter.

It should be apparent to those skilled in the art that the present invention may be embodied in many other specific forms without departing from the spirit or scope of the invention. Particularly, it should be understood that the invention may be embodied in the following forms.

(a) The wall 13*b* surrounding the inlet 13*a* may be replaced by a bypass groove or hole for the lubricating oil to avoid sudden drainage of the oil.

(b) In the preferred and illustrated embodiment, the OCV 3 is installed in the cylinder head 1 of the engine. However, the OCV 3 may be installed in a cam cap, which covers the camshaft, or in other locations, as long as the drain passage 12 leads to the cylinder head 1.

(c) In the preferred and illustrated embodiment, the OCV 3 is employed to control the hydraulic pressure of a ring gear type VVT mechanism. However, the OCV 3 may be employed to control other types of valve performance varying mechanisms that are driven by hydraulic pressure such as a vane type VVT mechanism.

(d) The present invention may be embodied in a mechanism that varies the amount of valve lift and its hydraulic pressure control apparatus. In this case, an oil switching valve (OSV) is employed as an oil control valve. The present invention may also be embodied in a mechanism that controls both the valve timing and the valve lift and its hydraulic pressure control apparatus.

Therefore, the present examples and embodiments are to be considered as illustrative and not restrictive and the invention is not to be limited to the details given herein, but may be modified within the scope and equivalence of the appended claims.

What is claimed is:

1. An apparatus for adjusting the valve performance of an internal combustion engine, the apparatus comprising:

a reservoir for reserving oil;

a cylinder head having a drainage pan, wherein the drainage pan receives the oil drained from operating components of the engine;

a mechanism for changing the valve performance, wherein the mechanism is hydraulically driven by oil pressure;

a control valve for controlling the oil flow to and from the mechanism;

a control valve drain passage for draining the oil from the control valve;

a drain well located between the control valve drain passage and the reservoir, the drain well having an upper opening in the cylinder head, wherein the control valve drain passage has an outlet connected to the drain well, and wherein oil in the control valve drain passage and in the drainage pan is led to the reservoir through the drain well; and a barrier positioned between the opening of the drain well and the drainage pan for restricting the oil flow from the drainage pan to the drain well.

2. The apparatus according to claim 1, wherein the opening of the drain well is located adjacent to the drainage pan, and wherein the barrier serves as a dam for the oil in the drainage pan.

3. The apparatus according to claim 2, wherein the drain well extends substantially vertically while the oil passage extends substantially horizontally.

4. The apparatus according to claim 2, wherein the drain well has an inner surface, and wherein the outlet of the control valve drain passage is formed in the inner surface of the drain well.

5. The apparatus according to claim 3, wherein the cross sectional area of the drain well is the greatest at the opening and is reduced at a position near the bottom of the drain well.

6. The apparatus according to claim 2, further comprising:

a camshaft for actuating the valve;

a rotor mounted on the camshaft, the rotor being rotatable relative to the camshaft;

an actuator, which is coupled to the rotor and the camshaft, for changing the relative rotational relationship between the camshaft and the rotor;

a first pressure chamber for applying oil pressure to said actuator to move the actuator in a first direction;

a second pressure chamber for applying oil pressure to said actuator to move the actuator in a second direction;

a first conduit for connecting the control valve to the first pressure chamber to supply oil to the first pressure chamber; and a second conduit for connecting the control valve to the second pressure chamber to supply oil to the second pressure chamber.

7. The apparatus according to claim 6, further comprising a pump for supplying the oil to the control valve.

8. The apparatus according to claim 7, wherein the control valve comprises a supply port for receiving the oil from the reservoir, a discharge port for supplying oil to each pressure chamber, and a drain port for draining oil to the reservoir.

9. The apparatus according to claim 8, wherein the control valve further comprises a valve member for closing an oil port, and an electromagnetic solenoid for moving the valve portion axially to adjust the opening amount of the oil port.

10. The apparatus according to claim 9, further comprising a controller for applying voltage to the solenoid to move the valve member axially.

11. Oil drain structure for a mechanism that adjusts the valve performance of a valve of an internal combustion engine, wherein the mechanism is driven by hydraulic oil pressure, the structure comprising:

a reservoir for reserving oil;

a cylinder head having a drainage pan, wherein the drainage pan receives the oil drained from operating components of the engine;

a control valve for controlling the oil flow to and from the mechanism;

a control valve drain passage for draining the oil from the control valve;

a drain well located between the control valve drain passage and the reservoir, the drain well having an upper opening in the cylinder head, wherein the control valve drain passage has an opening in the drain well, and wherein oil in the control valve drain passage and in the drainage pan is led to the reservoir through the drain well; and a barrier positioned between the opening of the drain well and the drainage pan for restricting the oil flow from the drainage pan to the drain well.

12. The structure according to claim 11, wherein the opening of the drain well is located adjacent to the drainage pan, and wherein the barrier serves as a dam for the oil in the drainage pan.

13. The structure according to claim 12, wherein the drain well extends substantially vertically while the oil passage extends substantially horizontally.

14. The structure according to claim 12, wherein the drain well has an inner surface, and wherein the opening of the control valve drain passage is formed in the inner surface of the drain well.

15. The structure according to claim 11, wherein the mechanism includes:

a camshaft for actuating the valve;

a rotor mounted on the camshaft, the rotor being rotatable relative to the camshaft;

an actuator, which is coupled to the rotor and the camshaft, for changing the relative rotational relationship between the camshaft and the rotor;

a first pressure chamber for applying oil pressure to said actuator to move the actuator in a first direction;

a second pressure chamber for applying oil pressure to said actuator to move the actuator in a second direction;

a first conduit for connecting the control valve to the first pressure chamber to supply oil to the first pressure chamber; and a second conduit for connecting the control valve to the second pressure chamber to supply oil to the second pressure chamber.

* * * * *